US007022273B2

(12) United States Patent
Dangayach et al.

(10) Patent No.: US 7,022,273 B2
(45) Date of Patent: Apr. 4, 2006

(54) PROCESS FOR MAKING STABLE POLYTRIMETHYLENE TEREPHTHALATE PACKAGES

(75) Inventors: Kailash Dangayach, Houston, TX (US); Kathleen Suzanne Kiibler, Katy, TX (US); Michele Buscemi, Grand Leez (BE); Dieter Wiemer, Wermelskirchen (DE); Hansjorg Meise, Köln (DE); Hoe Hin Chuah, Houston, TX (US); Adriano Birosel Pangelinan, Houston, TX (US); Houston Slade Brown, Houston, TX (US)

(73) Assignee: Shell Oil Company, Houston, TX (US)

( * ) Notice: Subject to any disclaimer, the term of this patent is extended or adjusted under 35 U.S.C. 154(b) by 190 days.

(21) Appl. No.: 10/369,023

(22) Filed: Feb. 19, 2003

(65) Prior Publication Data

US 2003/0160351 A1 Aug. 28, 2003

Related U.S. Application Data

(60) Provisional application No. 60/358,179, filed on Feb. 20, 2002.

(51) Int. Cl.
*B29D 28/00* (2006.01)
*B29C 49/08* (2006.01)
*B29C 47/88* (2006.01)

(52) U.S. Cl. ..... 264/103; 264/210.7; 264/210.8; 264/211.12; 264/211.17

(58) Field of Classification Search ..... 264/103, 264/210.7, 210.8, 211.12, 211.17
See application file for complete search history.

(56) References Cited

U.S. PATENT DOCUMENTS

| | | | | |
|---|---|---|---|---|
| 5,645,782 | A | 7/1997 | Howell et al. | 264/103 |
| 5,698,146 | A | 12/1997 | Schippers et al. | 264/103 |
| 6,284,370 | B1 | 9/2001 | Fujimoto et al. | 428/364 |

FOREIGN PATENT DOCUMENTS

| | | | |
|---|---|---|---|
| EP | 0949363 | A2 | 10/1999 |
| JP | 2000073230 | | 9/2002 |
| WO | WO 01/04393 | | 1/2001 |
| WO | WO 02/04332 | A1 | 1/2002 |
| WO | WO 02/06572 | A1 | 1/2002 |

OTHER PUBLICATIONS

International Search Report of Jun. 25, 2003.

*Primary Examiner*—Stephen J. Lechert, Jr.
(74) *Attorney, Agent, or Firm*—Richard Taylor

(57) ABSTRACT

A process for the production and for the winding of one polyester yarn, preferably multi-filament yarn, which comprises at least about 85 weight %, in relation to the total weight of the polyester yarn, of polytrimethylene terephthalate (PTT) wherein said process is characterized in that filaments of said polyester yarn is heat-treated, before it is wound on a bobbin, at a temperature in the range of about 70° C. to about 180° C. The method of accomplishing this is by heating the godets that are used in the spinning part of the process, preferably the last pair of godets, to relax the yarns so that the yarn package will not shrink significantly during storage and/or transportation. It is thus possible to obtain at least one PTT yarn package with long-term stability during storage and which is insensitive against elevated temperatures during storage and transport.

14 Claims, 1 Drawing Sheet

PROCESS FOR MAKING STABLE POLYTRIMETHYLENE TEREPHTHALATE PACKAGES

This application claims the benefit of U.S. Provisional Application No. 60/358,179 filed Feb. 20, 2002, the entire disclosure of which is hereby incorporated by reference.

FIELD OF THE INVENTION

The present invention relates to a process for the spinning and winding of polyester multi-filament yarns, which comprise at least 85 weight %, in relation to the total weight of the polyester filament, of polytrimethylene terephthalate (PTT).

BACKGROUND OF THE INVENTION

The production of continuous polyester multi-filament yarns, particularly polyethylene terephthalate (PET) multi-filament yarns, in a two-stage process is already known. Multi-filament yarns are spun and wound during the first stage and, during the second stage, multi-filament yarns are stretched into finished form and thermofixed or else stretch-textured into bulky multi-filament yarns. Between the two stages, the packages of the multi-filament yarns can be stored long-term and transported at elevated temperatures without any influence on the process conditions of the second texturing stage and the quality of the products.

The first step in converting polyester polymer chip to fabric is to make suitable yarn by a spinning process. The most common yarn produced by the spinning process is partially oriented yarn (POY). Experience with texturing processes have led us in the direction of POY yarn which has an elongation greater than 100%. In contrast to PET, yarn produced by the conventional process with polytrimethylene terephthalate (PTT) has resulted in many practical problems. One of the most serious problems that has been encountered is the instability of the yarn on the bobbin on which the final yarn is wound. The instability of the yarn can be observed in various forms including deformed packages, changes in the yarn properties as a function of time, and also changes in the yarn properties as a function of package depth. These problems have limited the use of PTT in further downstream processes.

In contrast to PET multi-filament yarns, polytrimethylene terephthalate (PTT) multi-filament yarns have a considerable shrinking tendency, both immediately after the spinning and upon the winding as well as several hours or days after the winding. This shrinking tendency leads to a shortening of the multi-filament yarns. The yarn package is thereby compressed so that, in an extreme case, the yarn package can no longer be taken off the chuck. During long-term storage or transport, especially at elevated temperatures, the yarn package does not maintain its desired cheese-like shape and forms bulges with hard edges causing not only severe unwinding problems but also leading to a worsening of the yarn characteristics, such as extreme increase of uster values. Only the limitation of the weight of the yarn packages to less than 2 kg provides a remedy for these problems which normally do not occur during the processing of PET yarns.

Furthermore, it has been observed that, in contrast to PET multi-filament yarns, PTT multi-filament yarns age to an increased degree during storage. A structural hardening appears, changing the characteristics of the multi-filament yarns (for example, boil-off shrinkage and degree of crystallization) with time. Industrial use requires that multi-filament yarns maintain their characteristics with time so that subsequent processing of said multi-filament yarns can be carried out continuously and provide multi-filament yarns with constant characteristics.

WO 01/04393 refers to a process wherein the multi-filament yarns are heat-treated by the use of heated godets. Neither the stability in storage nor the stability during transport of the yarn packages obtainable by said method is disclosed in WO 01/04393. A disadvantage of the process of WO 01/04393 consists in that it requires low spinning speeds to be effective. An increase of the spinning speed for economical reasons will decrease the contact time of the multi-filament yarns at the heated godets and therefore result in a decreased long-term stability of the yarn packages.

It would be advantageous to provide a process for the spinning and winding of polyester multi-filament yarn which can be carried out on a large technical scale and in an economical manner. The process in accordance with the invention should permit the highest possible take-up speeds, preferably greater than 2000 m/min.

It would be advantageous to provide to improve the storability of the polyester multi-filament yarn. The yarn should be able to be stored for a longer period of time, such as 11 weeks, for example, as well as to not be adversely affected by elevated temperatures during storage and transport. Shrinkage and deformation of the yarn package during the storage, particularly shrinking to such an extent that the yarn package cannot be taken off the chuck any longer, as well as the formation of bulges with hard edges, should be prevented to the highest extent possible so that no problems of unwinding occur during the subsequent processing of the yarn package.

SUMMARY OF THE INVENTION

The present invention is a process for the production and for the winding of polyester yarn which comprises at least about 85 weight %, in relation to the total weight of the polyester yarn, preferably multi-filament yarn, of polytrimethylene terephthalate (PTT). The process comprises extruding PTT, spinning the PTT into yarn wherein the yarn is wrapped around at least one pair of godets, and heat treating the filaments of said polyester yarns at a temperature in the range of about 70° C. to about 180° C., preferably about 80° C. to about 120° C., and most preferably about 90° C. to about 110° C. before they are wound on a bobbin. The method of accomplishing this is by heating the godets that are used in the spinning part of the process, preferably the last pair of godets, to heat the filaments which are wrapped around the godets. This is intended to relax the yarn so that the package (yarn wound on the bobbin in the winder) will not shrink significantly during storage and/or transportation. It is preferred that the take-up speed is at least about 2000 m/min, preferably about 2500 to about 4100 m/min. It is also preferred that the winding tension be very low, i.e., from about 0.01 to about 0.08 g/denier, preferably about 0.01 to about 0.02 g/denier. The winding speed is preferably greater than about 450 m/min.

DETAILED DESCRIPTION OF THE INVENTION

Figure 1:
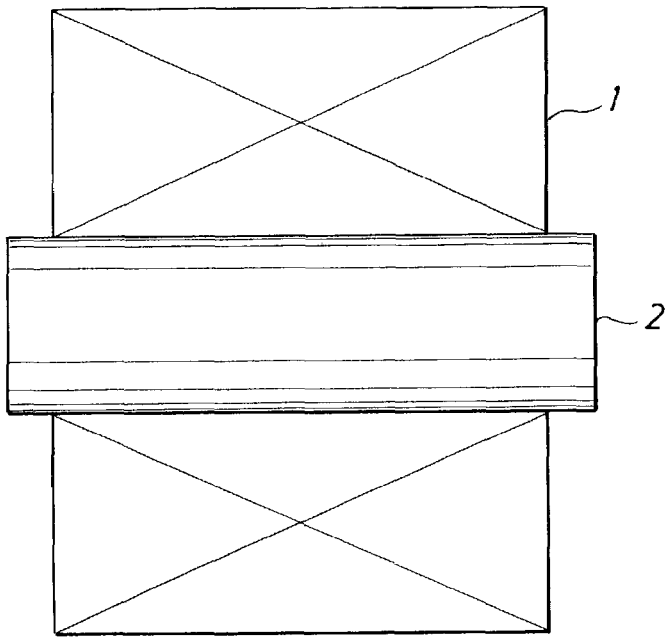
FIG. 1 is a schematic view showing the shape in a normal state of a cheese-like yarn package.

It is thus possible to obtain a PTT yarn package with long-term stability during storage and which is not adversely affected by elevated temperatures during storage and transport. In particular, said yarn package maintains its yarn characteristics as well as its cheese-like shape for a longer period of time, for example 11 weeks. Shrinkage and deformation of the yarn package during the storage, particularly shrinking to such an extent that bulges with hard edges form, is no longer observed so that no problems of unwinding occur during the processing of the yarn package.

The process in accordance with present invention may provide, at the same time, a series of additional advantages. These include, among others, the following:

- The process in accordance with the invention can be carried out in a simple way and manner, on a large technical scale and in an economical manner. In particular, the process permits the spinning and winding at high take-up speeds of more than about 2000 m/min.
- The process can be carried out at higher speeds, i.e., greater than about 3000 m/min, even about 4000 m/min, and the packages become very stable, the shrinkage decreases, and the uster is also significantly decreased.
- The polyester multi-filament yarns which can be obtained by means of the process can be further processed in a simple way and manner on a large technical scale and in an economical manner, in either a drawing or a draw texturing process. The texturing can thereby be carried out at speeds of greater than about 450 m/min.
- The stability of the package and its build-up are excellent when the winding tension is very low.
- Because of the high uniformity of the polyester multi-filament yarns which can be obtained by the process, it is possible to provide a cheese-like shape of the package which allows a uniform and nearly defect-free surface coloring and further processing of the polyester multi-filament yarns.
- The multi-filament yarns which can be obtained by means of the stretch texturing have a high tensile strength as well as a high elongation at break.

According to the present invention any type of winding machine may be used as long as polyester multi-filament yarns which comprise at least 85 weight %, in relation to the total weight of the multi-filament yarns, of PTT, may be wound wherein the winding speed is preferably more than about 2000 m/min. For further details reference is made to the technical literature, especially to the text-book "Synthetic Filaments" by F. Fourné (1995), published by the Hanser-Verlag, Munich in German, which is herein incorporated by reference. The conventional winding machines known in the art allow the simultaneous winding of one or more multi-filament yarns on one spindle, in particular the simultaneous winding of up to 12 multi-filament yarns, in order to improve the efficiency of the spinning process.

The present invention also refers to a process for the production and for the winding of at least one polyester yarn, preferably a multi-filament yarn, which comprises at least by about 85 weight %, in relation to the total weight of the polyester yarn, of polytrimethylene terephthalate (PTT). Polytrimethylene terephthalate (PTT) is already known in the art. Polytrimethylene terephthalate can be obtained by the polycondensation reaction of terephthalic acid with equimolar quantities of 1,3-propanediol. Mixtures with other polyesters are also conceivable. In accordance with the invention, the use of PTT is especially preferred.

The polyesters can be both homopolymers as well as copolymers. Suitable examples of copolymers include but are not limited to those which contain, in addition to the repeating PTT units, an additional amount of up to 15 mol. %, in relation to all repeating units of the polyester, of repeating units of normal comonomers, such as ethylene glycol, diethylene glycol, triethylene glycol, 1,4-cyclohexanedimethanol, polyethylene glycol, isophthalic acid, and/or adipinic acid, for example: In the present invention, however, the use of polyester homopolymers, i.e. PTT, is especially preferred.

The polyesters in accordance with the invention can contain normal quantities of additional additives as admixtures, such as catalysts, stabilizers, antistatic agents, antioxidants, flame retarding agents, colorants, colorant absorption modifiers, light stabilizers, organic phosphites, optical brighteners, and matting agents. The polyesters preferably contain from 0 to 5 weight % of additives, in relation to the total weight of the multi-filament yarn.

The polyesters that are usable in the sense of the present invention are, preferably, thermoplastically formable and can be spun into filaments. Polyesters that have a intrinsic viscosity in the range from about 0.70 dl/g to about 1.1 dl/g are thereby particularly advantageous.

The process of the present invention is not restricted to a special type of spinning process. Any conventional type of spinning process known in the art may be employed. A typical spinning process in accordance with the present invention is described below.

In the process in accordance with the invention, the molten polymer can, for example, be produced in an extruder from polymer chip, whereby it is particularly favorable to dry the chip in advance to a water content of less than or equal to about 30 ppm, particularly to a water content of less than or equal to about 15 ppm. The molten polyester is pressed into nozzle assemblies and extruded through the nozzle apertures of the nozzle plate of the assembly and into molten filaments by means of a spinning pump at constant rotational speed, wherein the rotational speed is adjusted in accordance with known computation formula in such a manner that the desired thread titer is achieved. The extruded filaments are subsequently cooled to temperatures below the solidification temperature. For the purposes of the invention, the solidification temperature is the temperature at which the melt passes into the solid state.

According to the present invention, it has proven to be particularly suitable to cool the filaments to a temperature at which they are essentially not sticky any longer. Cooling of the filaments to temperatures below their crystallization temperature, particularly to temperatures below their glass transition temperature, is particularly advantageous. Means for quenching or cooling filaments are known from the prior art. The filaments are bundled in an oiler pin which supplies the yarn with the desired amount of spin finish at a uniform rate. According to the invention, the multi-filament yarns are preferably entangled before being wound up.

The bundled yarns are drawn off by the use of a first godet system and guided to the winder. Further godet systems can be employed before the yarn is wound up in the winder assembly to form packages on the tube (bobbin). The optional further godet systems may be included for drawing, thermosetting, and relaxation of the yarn.

According to the present invention the polyester multi-filament yarns are heat-treated at a temperature in the range of about 70 to about 180° C., preferably about 80 to about 120° C., and most preferably between about 90 to about 110° C., prior to winding, wherein said heat-treatment may be accomplished by the use of heated godets, preferably the last pair of godets. Hot gases, heated contact rolls, and radiant heating may also be used to heat the yarn.

Figure 2:
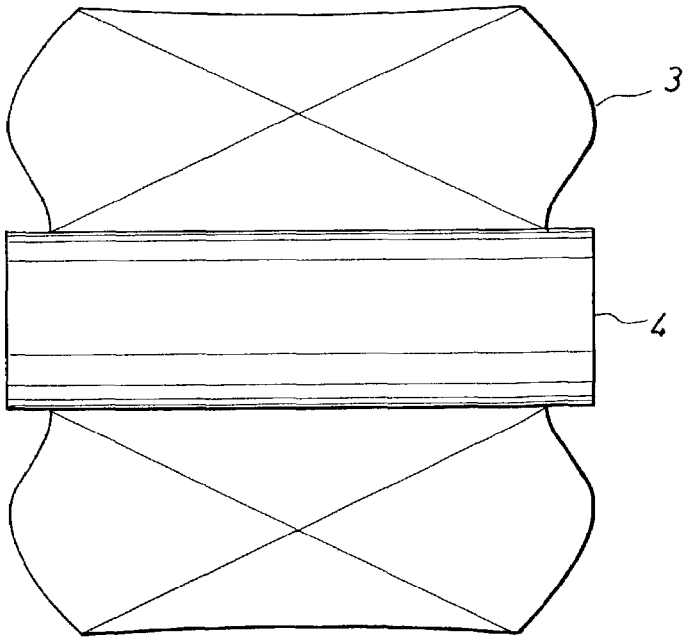
FIG. 2 is a schematic view showing the shape of yarn package in which bulging and shrinkage has occurred.

The process of the present invention allows the manufacture of yarn packages having a cheese-like shape, as schematically shown in FIG. 1 which illustrates a stable wound package 1 wound on a bobbin 2. Shrinkage and deformation of the yarn package during storage, particularly shrinking to such an extent that the yarn package cannot be taken off the chuck any longer, as well as the formation of bulges with hard edges, as schematically shown in FIG. 2 (which illustrates an unstable wound package 3 wound on bobbin 4), is not longer observed so that no unwinding problems occur during the subsequent processing of the yarn package. Thereby the polyester packages obtainable by the present method exhibit improved long-term stability during storage and are insensitive to elevated temperatures during storage and transport. In particular they maintain their favorable characteristics and cheese-like shape even during storage for a longer period of time, for example for 11 weeks at least.

To set the winding tension according to the invention, the winding speed of the POY is advantageously 0 to 5% below the take-up speed. It is preferable to select a winding speed 0 to 1% below the spinning take-up speed. The take-up speed preferably is greater than about 2,000 m/min, more preferably greater than about 3000 m/min, especially greater than about 4000 m/min.

The polyester multi-filament yarns obtainable by the present method exhibit superior properties compared with those of the prior art. Preferably they exhibit an elongation at break in the range of greater than 60% to 145%, preferably 80 to 130%, and a boil-off shrinkage in the range of 0 to 10%, especially in the range of 0 to 5%. This allows subsequent processing in a simple manner on a large technical scale and in an economical manner in either a drawing- or a draw texturing process. The texturing can thereby be carried out at speeds of greater than about 450 m/min. The multi-filament yarns which can be obtained by means of stretch texturing have a high tensile strength as well as a high elongation at break, low capillary breaks, and uniform dyeability at boiling temperature.

Analytical methods for determining the material parameters reported are well known to a person skilled in the art. They are discernible from the technical literature, for example from WO 99/07927, the disclosure of which is hereby expressly incorporated herein by reference.

The intrinsic viscosity is measured at 25° C. according to DIN 51562 in the viscometer from the firm Schott, and computed in accordance with a known formula, the Billmeyer equation. A mixture of phenol/1,2-dichlorobenzene is used as a solvent in a weight ratio of 1:1. The concentration of the solution is 0.5 g PTT to 100 ml of solution.

A DSC calorimeter device from the firm Perkin Elmer is used for the determination of the melting point, and for the temperature of crystallization and glass transition. In this, the sample is thereby first heated up to 280° C. and melted, and then suddenly chilled. The DSC measurement is carried out in the range from 20° C. to 280° C., with a heat rate of 10 K/min. The temperature values are determined by the processor.

The determination of the density of the filaments is carried out in a density/gradient column at a temperature of 23±0.1° C. Sodium bromides of two different concentrations were used (to bracket the expected density of materials to be tested). The result of the density measurement can be used for the calculation of the degree of crystallinity, since the density of the amorphous polyester $D_a$ and the density of the crystalline polyester $D_k$ are taken as the basis. The corresponding computation is known from the literature; for example, the following is valid for PTT: $D_a$=1.295 g/cm$^3$ and $D_k$=1.429 g/cm$^3$.

The titer is determined in the known manner (DIN EN ISO 2060) by means of a precision reeling machine and a weighing device. The prestressing thereby suitably amounts to 0.05 cN/dtex for filaments.

The tensile strength and the elongation at break are determined in Statimat equipment supplied by Textechno using the DIN EN ISO 5079 test protocol. The tensile strength is determined by dividing the values for the maximum breaking load by the titer, while the elongation at break is evaluated at the maximum load.

For the determination of the boil-off shrinkage, strands of filaments are treated, in a tension-free manner, in water at 95±1° C. for 10±1 min (ASTM D4301). The strands are produced by means of a reeling machine with a prestressing of 0.05 cN/dtex for POY. The measurement of the length of the strands before and after the temperature treatment is carried out at 0.2 cN/dtex. The boil-off shrinkage is evaluated in the known manner from the differences in lengths.

The normal uster values are determined with the Uster 4 Tester from Fa. Zellweg (CH-8610 Switzerland) and stated as uster % values.

The shrinkage was determined by the following procedure:

1. Measure dtex (denier) of the POY yarn
2. Calculate how many wraps needed to get a skein of total dtex of 5000 by the equation 5000 dtex/POY dtex/2
3. Hang 25 grams weight on the skein
4. Measure the initial length of the skein—LO
5. Place the skein with the weight in a constant temperature oven at 60° C. for 15 minutes
6. Remove the skein from the oven and place it at room temperature
7. Measure the new length of the skein—LF
8. Calculate % shrinkage by the equation:

$$\text{Shrinkage}=(LF-LO)/LO\times 100$$

The invention will be illustrated in the following by means of examples and a comparative example, without the invention having to be restricted to these examples.

EXAMPLE 1

The details of the operating conditions of the extrusion, spinning, and winding, are given in Table 1 below. The extruder in this case was a general purpose screw with a length to diameter ratio of 24 and pin type mixing at the end of the extruder. This type of extruder provides acceptable mixing for polyester spinning.

TABLE 1

Details of the Operating Conditions

| Material | Type | Unit | PTT |
|---|---|---|---|
| | Moisture | ppm | <30 |
| | IV | | 0.92 |
| Extruder | Type | | 4E4 (Barmag) |
| | Zone1 | ° C. | 250 or 245 |
| | Zone2 | ° C. | 255 or 250 |
| | Zone3 | ° C. | 260 or 255 |
| | Zone4 | ° C. | 260 or 255 |

TABLE 1-continued

Details of the Operating Conditions

| Material | Type | Unit | PTT |
|---|---|---|---|
| Measuring Head | Pressure | bar | 100 |
| | Temperature | ° C. | 257 or 253 |
| Spinning Head | Type | | SP50 |
| Shroud | | mm | 40 |
| Dowtherm | Boiler | ° C. | 260 or 255 |
| Spinning Pump | Capacity | ccm | 2.4 |
| | rpm | 1/min | 11.75 |
| | Melt Pressure before | bar | 94 |
| | Melt Temperature before | ° C. | 252.5 |
| | Melt Pressure After | bar | 76 |
| | Melt Temperature After | ° C. | 259.8 |
| Spin Pack | No. of Capillaries | | 36 |
| | Arrangement | | Honeycomb |
| | Cross section | | round |
| | Diameter | mm | 0.36 |
| | L/D | | 3 |
| | Filtration | | Metal |
| | Filter Medium 1 | μm | 59 g: 500–850 |
| | Filter Medium 2 | μm | 50 g: 250–355 |
| | Throughput | g/min | 33.6 |
| Quenching | Velocity | m/sec | 0.5 |
| | Temperature | ° C. | 20 |
| | Moisture | % | 65 |
| | Pressure | Pa | 180 |
| Spin Finish | Type | Type | Lurol 7087 or Cognis Stantex S6048/3 |
| | Dilution | % | 10 |
| | Distance to Spinnerette | mm | 1200 |
| Spin Finish Pump | capacity | ccm | 0.08 |
| | rpm | 1/min | 12–22 |
| Interlacing | Type | | Heberlein H132/C14 |
| | Location | | Variable |
| | Pressure | bar | 2 |
| Godet 1 | Surface | | Ceramic, Rz = 10 μm |
| Godet 2 | Surface | | Ceramic, Rz = 4.5 μm |
| Winder | Type | | Barmag CW6-920/6 |

The yarn used in these experiments was a 120 dtex/36. Table 2 incorporates the speed, shear rate, and draw down information.

TABLE 2

Operating Parameters as a Function of Speed

| Denier, dtex/counts | 120/36 | 120/36 |
|---|---|---|
| Capillary Diameter, mm | 0.36 | 0.36 |
| L/D Ratio | 3 | 3 |
| Speed, m/min | 2750 | 2600 |
| Flow Rate, g/min | 33.6 | 33.0 |
| Shear Rate, sec-1 | 2980 | 2927 |
| Draw Down | 342 | 329 |

Shear Rate (sec-1)=$4Q/(\rho\pi r^{**}3)$

Where, Q=flow rate (g/sec)

R=capillary radius (cm)

ρ=melt density, ~1.14 g/cc

In the above equation, no rabinowitsch correction is considered.

Draw Down=velocity of godet 1/velocity of the yarn at the capillary exit

EXAMPLE 2

In this set of experiments, the second godet pair was heated. A spinning speed of 2750 meters per minute (m/min) was used to get an elongation of around 100 percent. The main variables in this example were the temperature of the godet and the number of wraps (of the yarn around the godet). Table 3 gives details of the various parameters and the results obtained. One very significant observation from this data is that when the winding tension was extremely low, around 0.01 to 0.02 grams/denier, the package buildup for the PTT was excellent. Also, the shrinkage measurement shows that a minimum of 3.5 wraps would be required to reduce the shrinkage to near 0 at a reasonable temperature. Increasing the wraps to 5.5 or 7.5 gives very low shrinkage in the temperature range of 100 to 110° C. The results indicate that using the heated godet route as compared to the no heated godet process decreases the elongation about 8 to 10 percent at 2750 m/min. There is a small decrease in tenacity as the temperature or number of wraps are increased. The uster values increase as the number of wraps or temperature is increased.

TABLE 3

Effect of Godet 2 Temperature and Number of Wraps on Yarn Properties

| | | | | | | | | | | |
|---|---|---|---|---|---|---|---|---|---|---|
| Godet 1 | Speed, m/min | 2790 | 2755 | 2755 | 2745 | 2745 | 2745 | 2745 | 2745 | 2745 |
| | Temperature, ° C. | RT | RT | RT | RT | RT | RT | RT | RT | RT |
| | Wraps | 0.5 | 0.5 | 0.5 | 0.5 | 0.5 | 0.5 | 0.5 | 0.5 | 0.5 |
| Godet 2 | Speed, m/min | 2795 | 2760 | 2760 | 2750 | 2750 | 2750 | 2750 | 2750 | 2750 |
| | Temperature, ° C. | RT | 160 | 190 | 160 | 190 | 100 | 130 | 160 | 190 |
| | Wraps | 0.5 | 0.5 | 0.5 | 1.5 | 1.5 | 3.5 | 3.5 | 3.5 | 3.5 |
| Winding | Speed, m/min | 2750 | 2750 | 2750 | 2750 | 2750 | 2750 | 2750 | 2750 | 2750 |
| | Tension, cN | 5–6 | — | — | — | — | — | 1.5 | 1.5 | — |
| Yarn Properties | Count, dtex | 122 | 121 | 121 | 122 | 122 | 121 | 121 | 120 | 122 |
| | Tenacity, cN/dtex | 2.31 | 2.37 | 2.3 | 2.26 | 2.22 | 2.31 | 2.27 | 2.26 | 2.2 |
| | Elongation, % | 103 | 96.3 | 93.9 | 95.1 | 94.3 | 94.4 | 92.7 | 94 | 92.1 |
| | Uster, CV % | 0.92 | 1.45 | 1.41 | 1.65 | 1.83 | 1.74 | 1.71 | 1.6 | 1.6 |
| | Shrinkage @ 60, ° C. in air | 43 | 39 | 33 | 15 | 5 | 11 | 2 | 1 | 1 |

TABLE 3-continued

Effect of Godet 2 Temperature and Number of Wraps on Yarn Properties

| | | | | | | | | |
|---|---|---|---|---|---|---|---|---|
| Godet 1 | Speed, m/min | 2745 | 2745 | 2745 | 2745 | 2745 | 2745 | 2745 |
| | Temperature, ° C. | RT | RT | RT | RT | RT | RT | RT |
| | Wraps | 0.5 | 0.5 | 0.5 | 0.5 | 0.5 | 0.5 | 0.5 |
| Godet 2 | Speed, m/min | 2750 | 2750 | 2750 | 2750 | 2750 | 2750 | 2750 |
| | Temperature, ° C. | 100 | 130 | 160 | 80 | 100 | 130 | 160 |
| | Wraps | 5.5 | 5.5 | 5.5 | 7.5 | 7.5 | 7.5 | 7.5 |
| Winding | Speed, m/min | 2750 | 2750 | 2750 | 2750 | 2750 | 2750 | 2750 |
| | Tension, cN | 2.1 | — | — | 3 | 1.9 | 1.7 | 1.7 |
| Yarn Properties | Count, dtex | 121 | 121 | 122 | 121 | 121 | 121 | 122 |
| | Tenacity, cN/dtex | 2.27 | 2.28 | 2.22 | 2.38 | 2.29 | 2.28 | 2.22 |
| | Elongation, % | 94 | 95 | 95 | 97 | 96 | 94 | 94 |
| | Uster, CV % | 1.66 | 1.58 | 1.61 | 1.43 | 1.76 | 1.58 | 1.67 |
| | Shrinkage @ 60, ° C. in air | 6 | 1 | 1 | 19 | 3 | 1 | 1 |

EXAMPLE 3

In this example, the first godet pair was heated and the second godet pair was kept at room temperature. The winding speed was set at 2600 meters per minute to get slightly higher elongation compared to the winding speed of 2750 meters per minute. Also, an interlacer was placed before the first godet pair in order to increase the fiber integrity during storage and further handling.

Table 4 gives the details of the parameters used and the results obtained in this example. The results suggest that similar results are obtained when heating the first pair of godets as to when the second pair of godets is heated. Godet temperatures between 90 and 100° C. result in a significant reduction in the shrinkage. Elongation and tenacity decreases much less in this case compared to heating the second pair of godets. On the other hand, the uster value increased more in the temperature region where shrinkage values decreased substantially.

TABLE 4

Effect on Yarn Properties as Function of Godet 1 Temperature

| | | | | | | |
|---|---|---|---|---|---|---|
| Godet 1 | Speed, m/min | 2630 | 2612 | 2610 | 2610 | 2610 |
| | Temperature, ° C. | RT | 80 | 90 | 100 | 110 |
| | Wraps | 8.5 | 8.5 | 8.5 | 8.5 | 8.5 |
| Godet 2 | Speed, m/min | 2635 | 2617 | 2615 | 2615 | 2615 |
| | Temperature, ° C. | RT | RT | RT | RT | RT |
| | Wraps | 6.5 | 6.5 | 6.5 | 6.5 | 6.5 |
| Winder | Speed, m/min | 2600 | 2600 | 2600 | 2600 | 2600 |
| Yarn Tension | After Godet 1, cN | 12.2 | 2.6 | 1.7 | 1.1 | 0.6 |
| | Winding, cN | 2.8 | 2.2 | 2.5 | 2.5 | 2.1 |
| Yarn Properties | Count, dtex | 121.9 | 121.9 | 121.7 | 121.6 | 121.7 |
| | Tencity, cN/dtex | 2.29 | 2.28 | 2.27 | 2.23 | 2.2 |
| | Elongation, % | 103 | 101.6 | 103.2 | 103 | 101 |
| | Uster, CV % | 0.88 | 1.36 | 1.8 | 2.66 | 2.63 |
| | Shrinkage @ 60, ° C. in air, % | 48 | 29 | 12 | 4 | 2 |

EXAMPLE 4

The purpose of this example was to understand the impact of winding speeds on the uster values when a godet pair was heated. The results are shown in Table 5. At 3000 meters per minute, the process became much more stable and this resulted in lower uster values. The main drawback of this approach was that the elongation values also decreased as the winding speed was increased.

TABLE 5

Effect of Speed on the Yarn Properties While Heating Godet 1

| | | | | | |
|---|---|---|---|---|---|
| Godet 1 | Speed, m/min | 2610 | 2610 | 2812 | 3016 |
| | Temperature, ° C. | 90 | 100 | 95 | 95 |
| | Wraps | 8.5 | 8.5 | 8.5 | 8.5 |
| Godet 2 | Speed, m/min | 2615 | 2615 | 2817 | 3021 |
| | Temperature, ° C. | RT | RT | RT | RT |
| | Wraps | 6.5 | 6.5 | 6.5 | 6.5 |
| Winder | Speed, m/min | 2600 | 2600 | 2800 | 3000 |
| Yarn Tension | Winding, cN | 2.5 | 2.5 | 2.5 | 2.5 |
| Yarn Properties | Count, dtex | 121.7 | 121.6 | 121.6 | 121.1 |
| | Tencity, cN/dtex | 2.27 | 2.23 | 2.36 | 2.46 |
| | Elongation, % | 103 | 103 | 96 | 87 |
| | Uster, CV % | 1.8 | 2.66 | 1.6 | 1.3 |
| | Shrinkage @ 60, ° C. in air | 12 | 4 | 3 | 4 |

EXAMPLE 5

The purpose of this example was to determine the value of spinning at high speeds, around 4000 meters per minute or more, in obtaining stable packages. Prior experience without heating the yarn indicated that spinning around 4000 meters per minute would give approximately 10 to 15 percent shrinkage. In this experiment, the second pair of godets was heated and the temperature varied from 95 to 140° C. Table 6 gives the details of the experimental setup and the yarn properties obtained. Note that with an increase in temperature, the process became more stable, resulting in better uster values. At 4000 meters per minute, the effect on elongation was minimal with increased temperature.

TABLE 6

Effect of High Speed and Heating Godet 2 on the Yarn Properties

| | | | | | | | | |
|---|---|---|---|---|---|---|---|---|
| Godet 1 | Speed, m/min | 4020 | 4100 | 4048 | 4080 | 4510 | 4600 | 4570 |
| | Temperature, ° C. | RT | RT | RT | RT | RT | RT | RT |
| | Wraps | 4.5 | 0.5 | 0.5 | 0.5 | 4.5 | 0.5 | 0.5 |
| Godet 2 | Speed, m/min | 4040 | 4105 | 4085 | 4085 | 4540 | 4605 | 4575 |
| | Temperature, ° C. | RT | 95 | 120 | 140 | RT | 120 | 140 |
| | Wraps | 3.5 | 8.5 | 8.5 | 8.5 | 3.5 | 8.5 | 8.5 |
| Winder | Speed, m/min | 4000 | 4000 | 4000 | 4000 | 4500 | 4500 | 4500 |
| Yarn Tension | cN | 9.5 | 3.4 | 3.2 | 3 | 13.7 | 3.5 | 4.5 |
| Yarn Properties | Count, dtex | 104.5 | 121.2 | 121.3 | 121.6 | 101 | 121.6 | 121.1 |
| | Tenacity, cN | 2.64 | 2.78 | 2.83 | 2.81 | 2.59 | 2.83 | 2.88 |
| | Elongation, % | 70 | 69 | 67 | 67 | 68 | 66 | 64 |
| | Uster, CV % | 0.9 | 1.1 | 0.8 | 0.8 | 0.9 | 0.9 | 0.9 |
| | Shrinkage, 60, ° C., in air | 14 | 4 | 1.4 | 1.0 | 6.3 | 1.4 | 1.6 |

We claim:

1. A process for the spinning and winding of polyester yarn which is comprised of at least about 85 weight %, in relation to the total weight of the polyester yarn, of polytrimethylene terephthalate wherein said process comprises extruding polytrimethylene terephthalate, spinning the polytrimethylene terephthalate into yarn wherein the yarn is wrapped around at least one pair of godets, heat-treating said yarn at a winding tension in the range of 0.01 gm/denier to 0.02 gm/denier.

2. The process of claim 1 wherein the yarn is multifilament yarn.

3. The process of claim 1 wherein the yarn is heat-treated at a temperature in the range of about 80° C. to about 120° C. prior to winding.

4. The process of claim 3 wherein the yarn is heat-treated at a temperature in the range of about 90° C. to about 110° C. prior to winding.

5. The process of claim 1 wherein there is more than one godet pair and the yarn is heat-treated by heating the first godet pair.

6. The process of claim 1 wherein there is more than one godet pair and the yarn is heat-treated by heating at least one of the godet pairs after the first godet pair.

7. The process of claim 6 wherein there are two godet pairs and the yarn is heat-treated by heating the second godet pair.

8. The process of claim 1 wherein the take-up speed during the spinning step is greater than about 2000 m/mm.

9. The process of claim 8 wherein the take-up speed during the spinning step is from about 2500 to about 4100 m/mm.

10. The process of claim 1 wherein the winding speed is greater than about 450 m/mm.

11. A process for the spinning and winding of polyester yarn which is comprised of at least about 85 weight %, in relation to the total weight of the polyester yarn, of polytrimethylene terephthalate wherein said process comprises extruding polytrimethylene terephthalate, spinning the polytrimethylene terephthalate into yarn, heat-treating said yarn at a winding tension in the range of 0.01 gm/denier to 0.02 gm/denier.

12. The process of claim 11 wherein the yarn is multifilament yarn.

13. The process of claim 11 wherein the yarn is heat-treated at a temperature in the range of about 80° C. to about 120° C. prior to winding.

14. The process of claim 13 wherein the yarn is heat-treated at a temperature in the range of about 90° C. to about 110° C. prior to winding.

* * * * *